US007334434B2

(12) United States Patent
Mishima

(10) Patent No.: US 7,334,434 B2
(45) Date of Patent: Feb. 26, 2008

(54) SLIDING-TYPE FASTENER FOR ACCESSARY CHAIN

(75) Inventor: Shinya Mishima, Yokohama (JP)

(73) Assignee: Nihon Accessories Co., Ltd., Kanagawa (JP)

( * ) Notice: Subject to any disclaimer, the term of this patent is extended or adjusted under 35 U.S.C. 154(b) by 139 days.

(21) Appl. No.: 11/268,435

(22) Filed: Nov. 7, 2005

(65) Prior Publication Data

US 2006/0230786 A1 Oct. 19, 2006

(30) Foreign Application Priority Data

Apr. 13, 2005 (JP) ..... 2005-002272

(51) Int. Cl.
*A44C 5/02* (2006.01)

(52) U.S. Cl. ..... 63/38; 63/3; 63/33; 63/35; 59/2; 59/80

(58) Field of Classification Search ..... None
See application file for complete search history.

(56) References Cited

U.S. PATENT DOCUMENTS

| | | | | | |
|---|---|---|---|---|---|
| 295,869 | A * | 3/1884 | Herring | 63/21 |
| 296,542 | A * | 4/1884 | Draper | 63/21 |
| 301,491 | A * | 7/1884 | Gibbons | 54/59 |
| 540,578 | A * | 6/1895 | Cohn | 63/21 |
| D31,064 | S * | 6/1899 | Mirabeau | D11/2 |
| 1,124,518 | A * | 1/1915 | Qvarnstrom | 24/115 H |
| 4,321,804 | A * | 3/1982 | Borofsky et al. | 63/3.2 |
| 6,557,376 | B2 * | 5/2003 | Pratt | 63/3 |
| 6,901,771 | B2 * | 6/2005 | Ooide | 63/26 |
| 2002/0148250 | A1 * | 10/2002 | Pratt | 63/3 |
| 2003/0154742 | A1 * | 8/2003 | Ooide | 63/38 |
| 2006/0005578 | A1 * | 1/2006 | Tortoli | 63/35 |
| 2007/0084242 | A1 * | 4/2007 | Yoshiya | 63/38 |

FOREIGN PATENT DOCUMENTS

| | | |
|---|---|---|
| JP | 3114868 | 2/2000 |

* cited by examiner

*Primary Examiner*—Jack W. Lavinder
(74) *Attorney, Agent, or Firm*—Muramatsu & Associates

(57) ABSTRACT

A sliding-type faster for accessary chain has a hollow sphere having a pair of through holes, an elastic disk having a hole provided in the hollow sphere, and an accessary chain that slides into the through hole of the elastic disk. The outer diameter of the elastic disk for inserting the accessory chain is smaller than the inner diameter of the hollow sphere so that the outer surface of the elastic disk does not press tightly against the inner wall surface of the hollow sphere. Material such as polyurethane having high elasticity can be used for the elastic disk. The elastic disk can easily be installed in the hollow sphere by pressing or rolling it into a ball. Because of its increased thickness, the elastic disk will not slip out from the hollow sphere and achieve a long life.

7 Claims, 3 Drawing Sheets

SLIDING-TYPE FASTENER FOR ACCESSARY CHAIN

FIELD OF THE INVENTION

The present invention relates to a sliding-type fastener which is capable of slidably fastening the accessory chain into place while the accessory chain is inserted in through holes formed on a hollow sphere as well as in a through hole formed on an elastic disk fitted into the hollow sphere as a fastening member.

BACKGROUND OF THE INVENTION

A sliding-type fastener for an accessory chain, as described in Japanese patent number 3114868, has been proposed which is comprised of a hollow sphere with a donut-like elastic disk fitted in the hollow sphere, where the accessory chain is inserted into a through hole on the elastic disk and into a pair of through holes on the hollow sphere. By having an outer surface of the elastic disk tightly pressed against an inner wall surface of the hollow sphere, the elastic disk is held in place within the hollow sphere by the elasticity.

As mentioned above, since the outer surface of the elastic disk is tightly pressed against the inner wall surface of the hollow sphere, the elastic disk must be made of an elastic material that is relatively hard and semi-flexible instead of a one comprised with high elasticity and high flexibility in order to maintain the pressure force. Further, an outer diameter of the elastic disk must be larger than an inner diameter of the hollow sphere. As a result, the large elastic disk is forcefully pressed through the pair of through holes on the hollow sphere and to the inside of the hollow sphere by using a wire. However, this insertion work is a hard task and may damage the elastic disk during the insertion process.

Further, in order to press-in the relatively hard and semi-flexible elastic disk mentioned above through the pair of through holes on the hollow sphere, the elastic disk must inevitably be made thinner. As a result, the elastic disk may be broken or deteriorated over a long period of time as the accessory chain is repeatedly slid back and forth, thereby shortening its life span and lowering the quality of the product. This is a fatal problem for the accessory chain. Since the accessory chain is inserted through the thin and relatively hard elastic disk and slid back and forth, the smoothness of the sliding motion decreases over time and becomes harder to use.

SUMMARY OF THE INVENTION

Thus, it is an object of the present invention to solve the technical problems associated with the conventional chain fastener and fulfill the need for a fastener which is capable of fastening the accessory chain by sliding in place without having the outer surface of the elastic disk be tightly pressed against the inner wall surface of the hollow sphere.

The object of the present invention will be achieved by the following means. One aspect of the present invention is a sliding-type fastener for an accessory chain, where an outer diameter of an elastic disk is smaller than an inner diameter of a hollow sphere. Since the outer diameter of the elastic disk that will be fitted in the hollow sphere is smaller than the inner diameter of the hollow sphere, the elastic disk can be comparatively easily inserted through a pair of through holes of the hollow sphere.

In addition, since the outer surface of the elastic disk is not tightly pressed against the inner wall surface of the hollow sphere, a soft material with high flexibility can be used for the elastic disk. Therefore, the elastic disk can be rolled into a smaller shape by one's fingers so that it is easily inserted in the hollow sphere through the pair of through holes, thereby simplifying the process for inserting the elastic disk in the hollow sphere. Since the use of an elastic disk with high flexibility is possible, the elastic disk can easily be made thicker. As a result, in addition to the high flexibility, the elastic disk will not easily be broken from sliding back and forth over a long period of time, thereby extending the life span and increasing the product value as an accessory chain.

Another aspect of the present invention is a sliding-type fastener for an accessory chain as described above, where the elastic disk is made of polyurethane rubber that is rich in elasticity. As mentioned above, since the outer surface of the elastic disk does not have to be tightly pressed against the inner wall surface of the hollow sphere, the polyurethane rubber that is highly flexible and rich in elasticity can be used. As a result, the elastic disk, which can be pressed into a smaller shape, can be easily inserted through the pair of through holes of the hollow sphere and to the inside of the hollow sphere, thereby improving the work efficiency.

Still another aspect of the present invention is a sliding-type fastener for an accessory chain described above, where an outer diameter of the elastic disk is 1.5 to 2.5 times larger than an inner diameter of the through holes on the hollow sphere. As mentioned above, since the outer surface of the elastic disk does not have to be tightly pressed against the inner wall surface of the hollow sphere and the highly flexible material can be used for the elastic disk, the outer diameter of the elastic disk can be 1.5 to 2.5 times larger than the inner diameter of the through holes of the hollow sphere. As a result, the elastic disk can be easily inserted in the hollow sphere through the pair of through holes, thereby making the procedure easier and improving the work efficiency.

Another aspect of the present invention is a sliding-type fastener for an accessory chain defined in either one of the above described inventions, where the outer diameter of the elastic disk is 1.5 to 2.5 times larger than its thickness. As mentioned above, since the outer surface of the elastic disk does not have to be tightly pressed against the inner wall surface of the hollow sphere and the highly flexible material can be used for the elastic disk, the outer diameter of the elastic disk can be 1.5 to 2.5 times larger than its thickness.

In other words, the thickness of the elastic disk is 1/1.5 to 1/2.5 of the outer diameter, which is sufficiently thick and flexible compared to the conventional elastic disk that is harder and less flexible. As a result, the accessory chain can smoothly slide back and forth while being inserted through the through hole at the center of the elastic disk with less damages to the elastic disk and accessory chain, thereby achieving a longer life span which is also resulted from the increased thickness of the elastic disk. Further, since the elastic disk is thicker than the conventional example, the elastic disk that is rich in elasticity will not easily slip out from the pair of through holes of the hollow sphere. Even if the elastic disk is made thicker, it can still be easily inserted into the hollow sphere due to its smaller outer diameter.

Still another aspect of the present invention is a sliding-type fastener defined in either one of the inventions noted above, where the through hole of the elastic disk is formed to a shape that matches a cross sectional shape of the accessory chain that will be inserted therethrough. When the through hole of the elastic disk is shaped like the cross-section of the accessory chain, the strength of the thinnest part on the elastic disk can be weakened because the through hole is not a true cylindrical shape. However, as previously mentioned, this will not cause a problem since the outer surface of the elastic disk does not have to be tightly pressed against the inner wall surface of the hollow sphere. Therefore, the shape of the through hole is not limited to a circular shape, hence allowing any shape to be feasible. In other words, like the shape of the cross sectional shape of the accessory chain to be inserted, the through hole can be of any shape, and the sliding motion will always be smooth regardless of what shape the accessory chain has. Further, even if the wall of the elastic disk is thin and weak, the elastic disk can be made thicker to overcome that weakness.

As mentioned above, since the outer diameter of the elastic disk is smaller than the inner diameter of the hollow sphere that will encompass the elastic disk, the elastic disk can be relatively easily inserted into the hollow sphere through the pair of through holes on the hollow sphere. In addition, since the outer surface of the elastic disk is constructed such that it is not tightly pressed against the inner wall surface of the hollow sphere, the elastic disk can be made of the highly flexible and soft material, which then can be rolled into a smaller shape by one's fingers and easily inserted through the pair of through holes of the hollow sphere and to the inside of the hollow sphere. Therefore, since the elastic disk of high flexible property is used, the thickness of the elastic disk can be increased, and as a result, the accessory chain will not easily be deteriorated over a long period of time from repeated use of sliding motion, thereby expanding its life span as well as improving its quality.

As mentioned above, since the outer surface of the elastic disk does not have to be tightly pressed against the inner wall surface of the hollow sphere, polyurethane that has a low pressure force and high flexibility as well as rich in elasticity, can be used to make the elastic disk. As a result, it can be easily inserted through the pair of through holes of the hollow sphere to the inside of the hollow sphere while being pressed into a smaller shape, thereby improving the work efficiency.

As mentioned above, since the outer surface of the elastic disk does not have to be tightly pressed against the inner wall surface of the hollow sphere and the highly flexible material can be used to make the elastic disk, the outer diameter of the elastic disk can be 1.5 to 2.5 times larger than the inner diameter of the pair of through holes of the hollow sphere, as mentioned above. As a result, the elastic disk can be easily inserted through the pair of through holes of the hollow sphere to the inside of the hollow sphere, thereby improving the work efficiency.

As mentioned above, since the outer surface of the elastic disk does not have to be tightly pressed against the inner wall surface of the hollow sphere and the highly flexible material can be used to make the elastic disk, the outer diameter of the elastic disk can be made 1.5 to 2.5 times larger than its thickness, as mentioned above. In other words, the thickness of the elastic disk is 1/1.5 to 1/2.5 of its outer diameter, and compared to the conventional less flexible and harder elastic disk, the elastic disk of the present invention can be made sufficiently thicker and softer. As a result, the accessory chain can smoothly slide back and forth while being inserted in the through hole at the center of the elastic disk. Further, there will be less damage to the elastic disk and accessory chain, thereby expanding the life span of the accessory chain which also resulted from the increased thickness of the elastic disk. Moreover, since the elastic disk is thicker, the elastic disk that is rich in elasticity will not easily slip out of the pair of through holes of the hollow sphere. Even though the thickness of the elastic disk is increased, the elastic disk can still be easily inserted into the hollow sphere because the outer diameter is small.

When the through hole of the elastic disk has a shape that corresponds to the shape of the cross section of the accessory chain, the thinnest part of the wall can be weaker in strength because the through hole is not a true cylindrical shape. However, as mentioned above, since the outer surface of the elastic disk does not have to be tightly pressed against the inner wall surface of the hollow sphere, this weakness in strength will not cause a problem. Therefore, the shape of the through hole is not limited to a true cylinder shape, allowing the through hole to have any shape. In other words, the sliding motion of the accessory chain will always be smooth without regard to the shape. Further, even if there are parts that are thinner and weaker in strength, since the thickness of the elastic disk can be increased, it is possible to overcome such a problem.

DETAILED DESCRIPTION OF THE EMBODIMENTS

Figure 1:
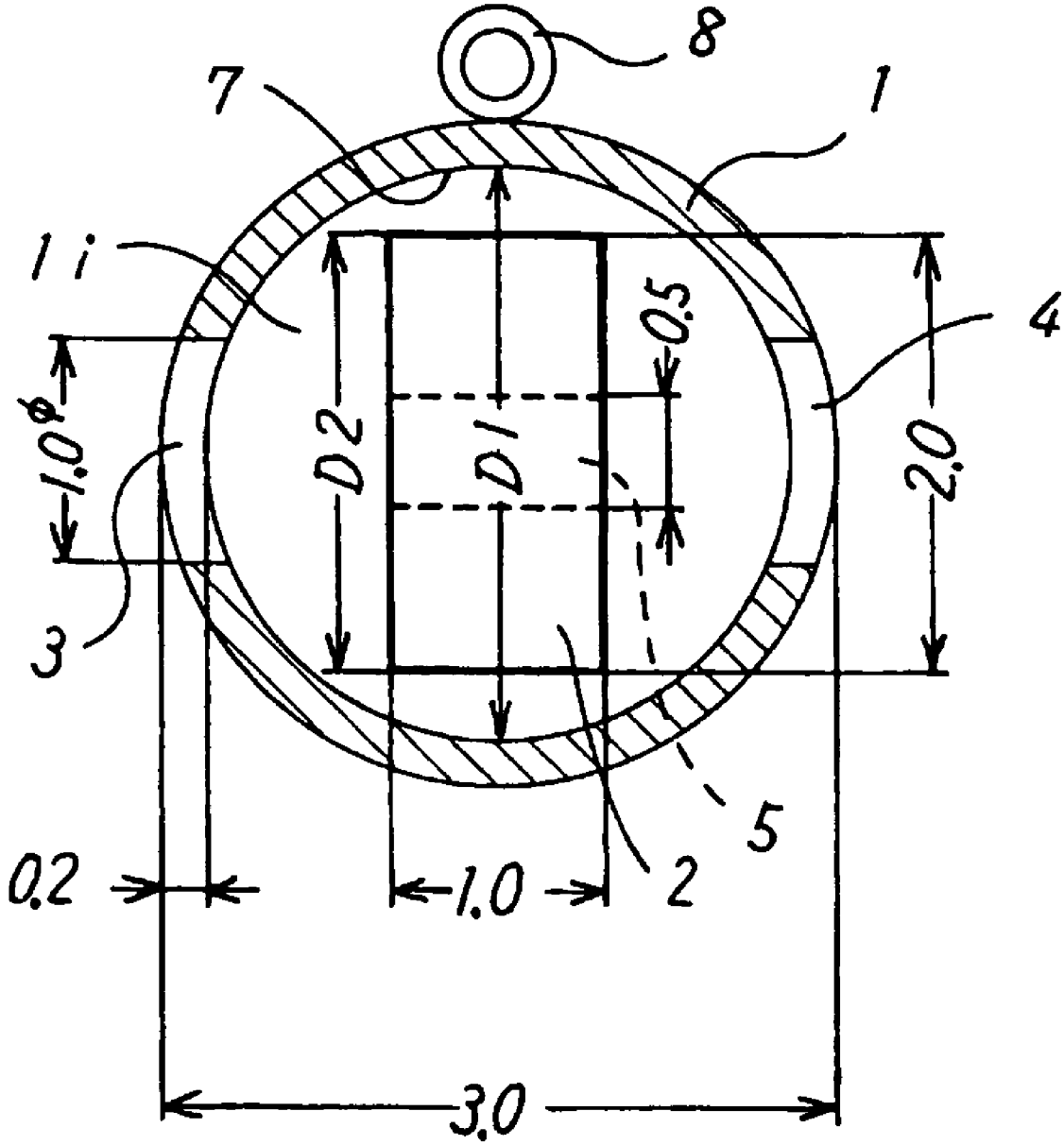
FIG. 1 is a cross-sectional view of the sliding-type fastener for an accessory chain in accordance with the present invention.

Next, the embodiment of the sliding-type fastener for an accessory chain under the present invention will be described in detail. FIG. 1 is a cross sectional diagram of the sliding-type fastener for accessory chain according to the present invention where an elastic disk 2 is incorporated inside a hollow sphere 1. Only the hollow sphere 1 is illustrated as a cross sectional diagram, and the elastic disk 2 is illustrated as a side view.

Figure 2:
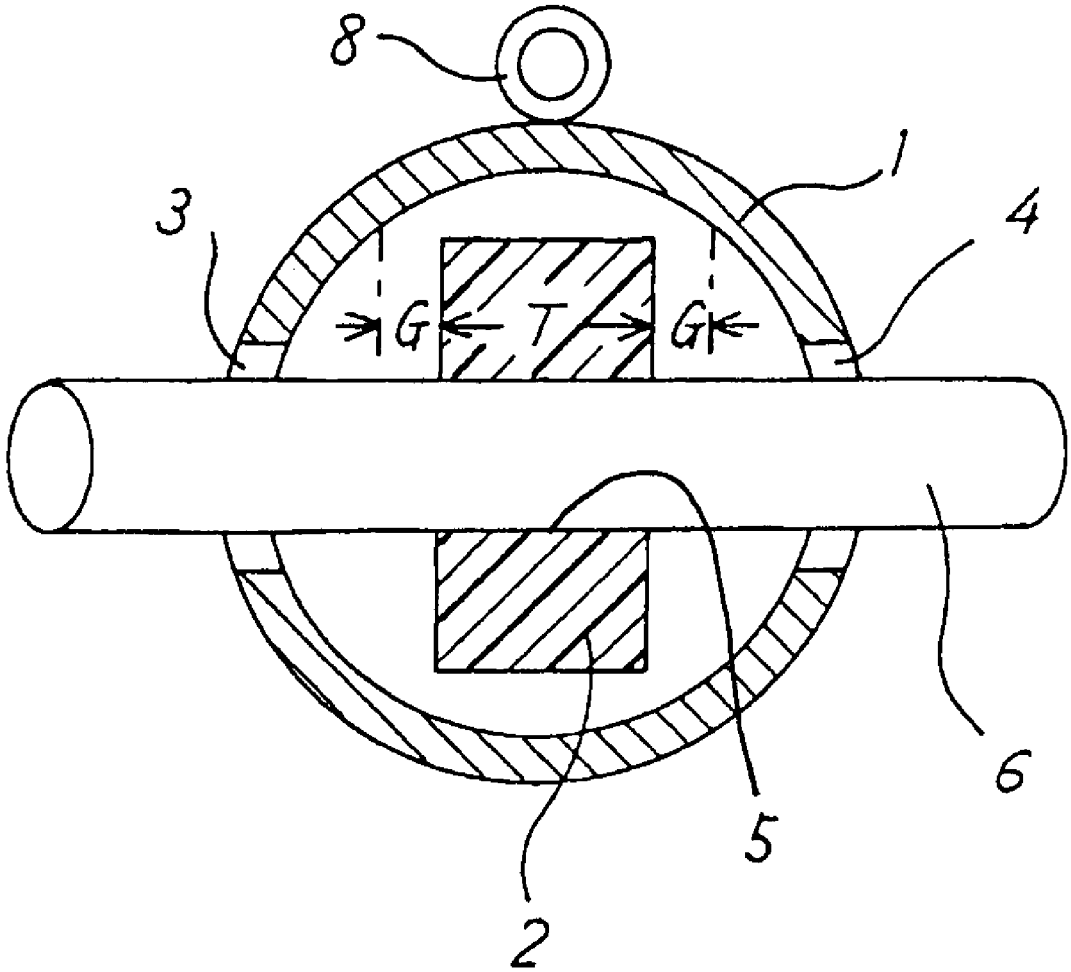
FIG. 2 is a cross-sectional view of the sliding-type fastener of FIG. 1 showing the way of using the fastener of the present invention.

The hollow sphere 1 has a pair of through holes 3, 4 for inserting the accessory chain therein. Further, on the elastic disk 2, a small through hole 5 is provided at the center for inserting the accessory chain 6. Therefore, as shown in FIG. 2, the accessory chain 6 is inserted in the pair of through holes 3, 4 on the hollow sphere 1 and in the through hole 5 of the elastic disk 2, where the accessory chain 6 can slide back and forth through the elastic disk 2.

When the inner diameter of the hollow sphere 1 is denoted as D1, and the outer diameter of the elastic disk 2 is denoted as D2, then the relationship between them is expressed as D1>D2. Therefore, unlike the configuration of the conventional fastener, the outer surface of the elastic disk 2 is not tightly pressed against an inner wall surface 7 of the hollow sphere 1. As a result, since the diameter of the elastic disk 2 is made smaller, inserting the elastic disk inside the hollow space 1*i* from either through hole 3 or 4 on the hollow sphere 1 will be much easier than in the conventional technology.

Moreover, since the outer surface of the elastic disk 2 does not have to be tightly pressed against the inner wall surface 7 of the hollow sphere 1, material that is rich in elasticity such as polyurethane can be used for the elastic disk 2. As a result, it can be easily rolled or pressed by one's fingers and inserted into the hollow space 1*i* from either through hole 3 or 4, thereby making the insertion process simpler than that in the prior art.

As mentioned above, since the outer surface of the elastic disk 2 does not have to be tightly pressed against the inner wall surface 7 of the hollow sphere 1, the outer diameter D2 of the elastic disk 2 can be 1.5 to 2.5 times larger than the inner diameter of each through hole 3, 4, namely, the multiplying factor can be decreased from the conventional technology. If the outer diameter D2 is smaller than 1.5 times of the inner diameter of each through hole 3, 4, then the elastic disk 2 may easily slip out from either of the through holes. If the outer diameter D2 is larger than the 2.5 times of the inner diameter of each through hole 3, 4, then inserting the elastic disk 2 into the hollow space 1*i* of the hollow sphere 1 may become difficult. Therefore, compared to the conventional structure, since the multiplying factor relating to the pair of through holes is decreased, insertion of the elastic disk 2, which is made of a flexible material with high elasticity, through either through hole 3 or 4 and into the hollow space 1*i* of the hollow sphere 1 can be easily done.

Moreover, the conventional tightly pressed structure is comprised of a relatively hard and semi-flexible elastic disk where its thickness needs to be sufficiently smaller, otherwise, inserting it inside the hollow space 1*i* through either through hole 3 or 4 would be difficult. However, in the present invention, since the high elasticity material such as polyurethane is used, the elastic disk 2 can easily be inserted in the hollow sphere 1 even if it is made thicker. As a consequence, the size of the outer diameter D2 of the elastic disk 2 can be 1.5 to 2.5 times of its thickness T. In other words, the thickness T of the elastic disk 2 can be 1/1.5 to 1/2.5 of the outer diameter, thereby enabling to make it sufficiently thicker compared to the conventional structure.

As explained above, the thickness T of the elastic disk 2 can be increased. Thus, when the accessory chain 6 is inserted in the through hole 5 on the elastic disk 2 within the hollow sphere 1, as shown in FIG. 2, the elastic disk 2 with high elasticity will not be able to slip out from the space between the accessory chain 6 and the pair of through holes 3, 4, where the accessory chain 6 is slidably held in place. Further, even if the elastic disk 2 is made thicker, since the outer diameter is small and the elastic disk 2 has high elasticity, inserting it into the hollow space 1*i* can be easily done.

Typically, an outer diameter of the accessory chain 6 that will be inserted through the pair of through holes 3, 4 is about 50%-70% of the dimension of the inner diameter of the pair of through holes 3, 4. Further, the inner diameter of the through hole 5 on the elastic disk 2 is about 40%-60% of the inner diameter of the pair of through holes 3, 4. The drawing shows an example of such preferable dimensions involved in the fastener of the present invention.

Since the thickness T of the elastic disk 2 is increased as mentioned above, the length of the through hole 5 for inserting the accessory chain 6 is increased accordingly, thus the sliding motion of the accessory chain 6 becomes smoother than that of the conventional example. Namely, since the surface of the accessory chain has an irregular and complicated shape, when the elastic disk is thin, inflexible, and relatively hard as in the conventional structure, the smoothness of the sliding motion is impaired and it becomes impossible to achieve the smooth sliding motion. Moreover, in the conventional technology, since a metallic accessory chain is slid through the through hole of the thin and relatively hard elastic disk, the through hole 5 on the elastic disk as well as the accessory chain 6 will quickly wear down, thus shortening its life span. However, in the present invention, since the through hole 5 is longer and its inner wall surface is rich in elasticity, the sliding motion becomes stable and smooth, and the inner surface of the through hole as well as the accessory chain will not wear down. The elastic disk 2 can be easily manufactured by using a polyurethane sheet with the thickness T, where the outer surface and the through hole, which is shaped like a donut, is punched out at the same time.

In the conventional structure, the outer surface of the elastic disk 2 must be tightly pressed against the inner wall surface 7 of the hollow sphere, where the dimension of the radial direction must be constant and the physical strength must be maintained. However, in the present invention, since the pressure force is not necessary, the elastic disk 2 does not need to be strong in the radial direction. As a result, as shown in FIGS. 3A-3C, the shape of the through hole 5 in the center of the elastic disk 2 for inserting the accessory chain 6 can be of any shape that corresponds to the cross sectional shape of the accessory chain 6.

Figure 3C:
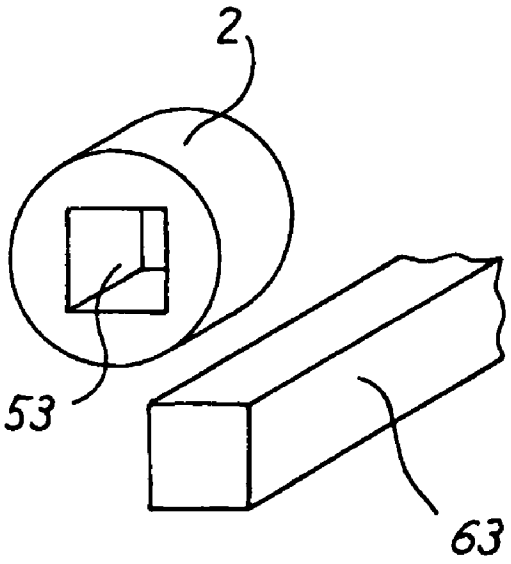
FIGS. 3A-3C are perspective views of the through holes of the elastic disk that correspond to the cross sectional shapes of the accessory chains.
Figure 3B:
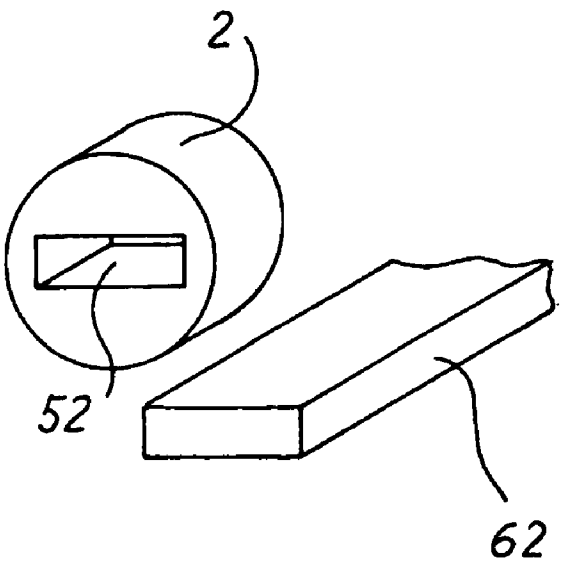
Figure 3A:
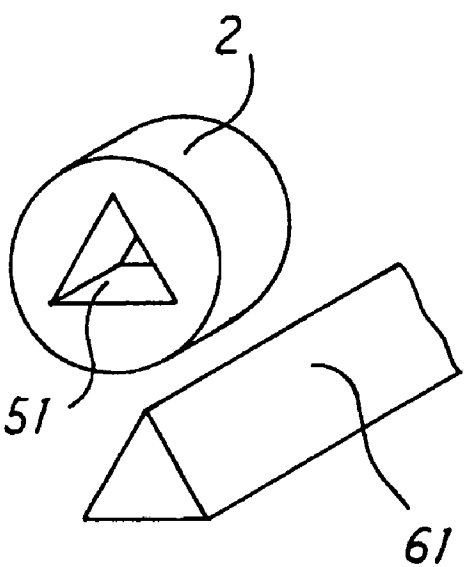

The accessory chain 61 in FIG. 3A has a triangular cross sectional shape, the accessory chain 62 in FIG. 32 has a rectangular cross sectional shape, and the accessory chain 63 in FIG. 3C has a square cross sectional shape. The through hole on the elastic disk 2 also has a triangular through hole 51, a rectangular through hole 52, and a square through hole 53 so that they are consistent with the shape of the accessory chain. The part between these through holes 51, 52, 53 and the outer surface of the elastic disk is thinner than the rest, and thus it is not much durable. However, since the outer surface of the elastic disk and the inner wall surface 7 of the hollow sphere 1 do not have to be tightly pressed against one another, this weakness in strength will not cause any problem. Therefore, the shape of the through hole does not have to be a true circle, and can be of any shape such as the through holes 51, 52, 53 shown in FIGS. 3A-3C which correspond to the cross sectional shapes or the cut-off end surfaces of the accessory chain. Such cross sectional shapes also allow the smooth sliding motion of the accessory chain.

When using a product with an accessory chain inserted therethrough in a manner explained above, there may be looseness due to the space G between the inner wall surface 7 of the hollow sphere 1 and either side of the elastic disk 2 as shown in FIG. 2. However, this looseness will not affect the usage and will not be any inconvenience. Further, since the material such as polyurethane that is rich in elasticity is used for the elastic disk 2, a buffering effect takes place when the elastic disk 2 contacts the inner wall surface 7, which prevents any damages or wear down.

According to the present invention, the outer diameter of the elastic disk for inserting the accessory chain is made smaller than the inner diameter of the hollow sphere so that the outer surface of the elastic disk does not press tightly against the inner wall surface of the hollow sphere. As a result, the material such as polyurethane having high elasticity can be used, and the elastic disk can easily be inserted in the hollow sphere by pressing or rolling it into a ball even if it is made thick so that the elastic disk will not slip out from the hollow sphere.

What is claimed is:

1. A sliding-type fastener for an accessory chain, comprising:

a hollow sphere having a pair of through holes for inserting the accessory chain therein; and an elastic disk having a through hole for inserting the accessory chain therein, said elastic disk being installed in the hollow sphere through of the pair of through holes;

wherein an outer diameter of said elastic disk is smaller than an inner diameter of said hollow sphere to an extent that looseness is created due to a space between an inner wall surface of the hollow sphere and an either one of sides of the elastic disk.

2. A sliding-type fastener for an accessory chain as defined in claim 1, wherein said elastic disk is made of polyurethane having high elasticity, and wherein an outer diameter of said accessory chain is about 50% to 70% of an inner diameter of said pair of through holes, and an inner diameter of said through hole of said elastic disk is about 40% to 60% of the inner diameter of the pair of through holes.

3. A sliding-type fastener for an accessory chain as defined in claim 2, wherein an outer diameter of said elastic disk is 1.5 to 2.5 times larger than the inner diameter of the through holes of said hollow sphere.

4. A sliding-type fastener for an accessory chain as defined in claim 1, wherein an outer diameter of said elastic disk is 1.5 to 2.5 times larger than an inner diameter of the through holes of said hollow sphere.

5. A sliding-type fastener for an accessory chain as defined in claim 4, wherein the outer diameter of said elastic disk is 1.5 to 2.5 times larger than a thickness of the elastic disk.

6. A sliding-type fastener for an accessory chain as defined in claim 1, wherein an outer diameter of said elastic disk is 1.5 to 2.5 times larger than a thickness of the elastic disk.

7. A sliding-type fastener for an accessory chain as defined in claim 1, wherein the through hole of said elastic disk has a shape that corresponds to a cross sectional shape of the accessory chain to be inserted therein.

* * * * *